United States Patent [19]

Matchett

[11] 3,964,501

[45] June 22, 1976

[54] HAIR GROOMING APPARATUS

[76] Inventor: Robert R. Matchett, R.R. 2, Box 275, Carmel, Ind. 46032

[22] Filed: Feb. 3, 1975

[21] Appl. No.: 546,681

[52] U.S. Cl. ..... 132/11 A; 132/9

[51] Int. Cl.[2] ..... A45D 24/00

[58] Field of Search ..... 132/112, 122, 126, 115, 132/9, 11 A, 11 R, 37 R; 401/190

[56] References Cited

UNITED STATES PATENTS

| | | | |
|---|---|---|---|
| 2,225,123 | 12/1940 | Madore | 132/122 |
| 2,652,949 | 9/1953 | Martin | 132/84 R |
| 2,987,743 | 6/1961 | Capps | 401/190 |
| 3,066,683 | 12/1962 | Pace | 132/11 |
| 3,094,130 | 6/1963 | Wiener | 401/190 |
| 3,696,818 | 10/1972 | Weber | 132/9 |
| 3,714,950 | 2/1973 | Miska et al. | 132/112 |
| 3,721,250 | 3/1973 | Walter | 132/11 A |

*Primary Examiner*—G.E. McNeill

[57] ABSTRACT

A spray comb or brush which comprises an elongated member having a support portion connected to a handle portion. The member has an elongated passage formed therein having a section in the support portion and a section in the handle portion. A comb or brush device is removably attached to the support portion and has a chamber therein communicating with the passage and with the teeth or bristles. An elongated tube having opposite ends is positioned in the passage, the tube having a spray nozzle adjacent one end for spraying liquid into the chamber for distribution into the teeth or bristles. A source of liquid under pressure is provided having a valve in the handle section of the passage, the valve being actuated by a depressible stem element. The tube is axially movable in the passage and the valve stem element is received in the other end of the tube. A manual control lever is provided connected to the tube for axially moving the same thereby to depress the valve stem element and actuate the valve to admit fluid to the tube and thence to the chamber of the comb or brush.

10 Claims, 8 Drawing Figures

HAIR GROOMING APPARATUS

BACKGROUND OF THE INVENTION

1. Field of the Invention

This invention relates generally to apparatus for grooming the hair while spraying a liquid thereon, and more particularly to a spray comb or brush.

2. Description of the Prior Art

It is frequently desirable to groom the hair, as by combing or brushing, while simultaneously spraying a hair dressing thereon. Various types of spray combs have been proposed for performing such a function; however, to the best of the present applicant's knowledge, such prior devices in general have been characterized by their complexity, or have not been designed for use with a pressurized source of hair dressing, or have been heavy and cumbersome to use.

SUMMARY OF THE INVENTION

The invention, in its broader aspects, provides apparatus for grooming the hair while spraying a liquid thereon comprising an elongated member having a support portion connected to a handle portion, the member having an elongated passage formed therein extending between the portions. A hair grooming device is carried by the support portion and has a plurality of hair grooming elements thereon, the device having a chamber therein communicating with the passage and elements. An elongated tube is provided in the passage and having opposite ends, the tube having means thereon adjacent one end thereof for spraying liquid into the chamber for distribution to the elements, the other end of the tube being adapted to be connected to a source of liquid. Control means is provided on the support portion intermediate the handle portion and the grooming device and coupled to the liquid source for causing a flow of liquid in the tube. In the preferred embodiment, the source of liquid is pressurized.

It is accordingly an object of the invention to provide improved hair grooming apparatus.

Another object of the invention is to provide improved apparatus for grooming the hair while simultaneously spraying a liquid thereon.

A further object of the invention to provide an improved spray apparatus for grooming the hair usable with a pressurized container of hair dressing.

The above-mentioned and other features and objects of this invention and the manner of attaining them will become more apparent and the invention itself will be best understood by reference to the following description of an embodiment of the invention taken in conjunction with the accompanying drawings.

DESCRIPTION OF THE PREFERRED EMBODIMENTS

Figures 1, 3, 4, 5:
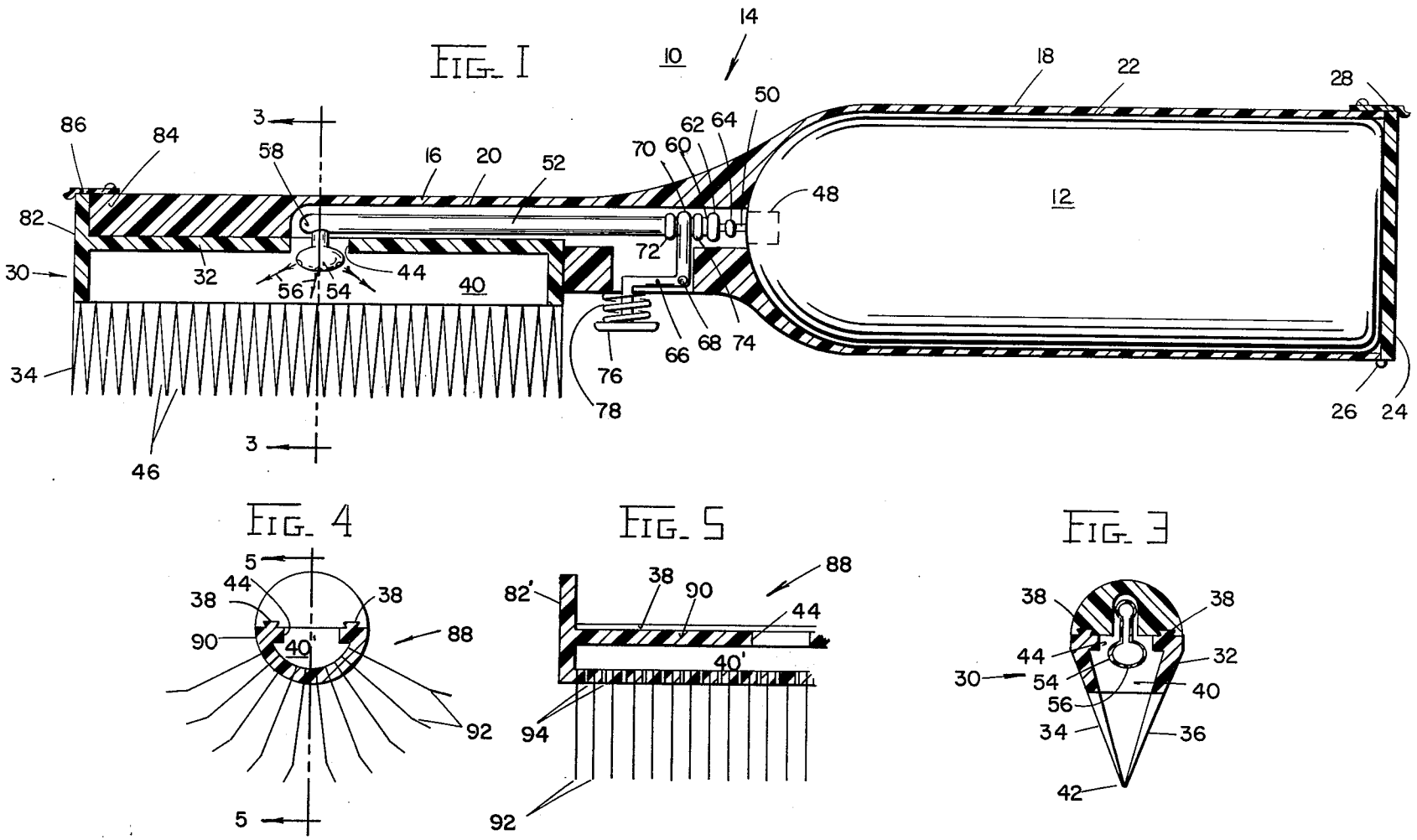
FIG. 1 is a longitudinal sectional view showing one embodiment of the invention incorporating a comb device.
FIG. 3 is a cross-sectional view taken generally along the line 3—3 of FIG. 1.
FIG. 4 is a cross-sectional view of a brush device usable with the embodiment of FIG. 1.
FIG. 5 is a sectional view taken generally along the line 5—5 of FIG. 4.
Figure 2:
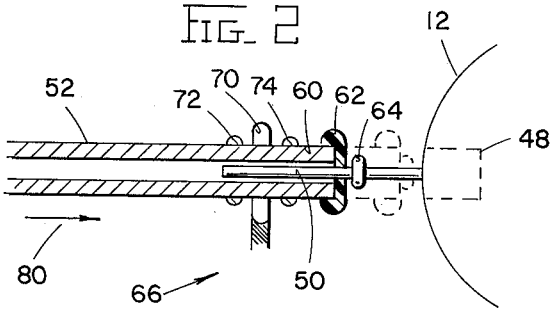
FIG. 2 is a fragmentary sectional view showing a detail of the embodiment of FIG. 1.

Referring now to FIGS. 1, 2 and 3, there is shown an embodiment of the invention, generally indicated at 10, for use with a conventional pressurized container 12 of hair dressing liquid. Apparatus 10 comprises member 14 having support portion 16 joined to handle portion 18; member 14 is preferably integrally formed of molded plastic material.

An elongated passage is formed in member 14 having section 20 in support portion 16 joined to section 22 in handle portion 18. Passage section 22 is enlarged with respect to passage section 20 to form a compartment to receive and accommodate container 12. Cover member 24 is hingedly connected to handle portion 18, as at 26, and serves to close passage section 22 and to retain container 12 in position. Cover member 24 may be maintained in closed position by spring latch 28.

Comb device 30 is removably attached to support portion 16 of member 14. Comb device 30 comprises upper portion 32 having two rows 34, 36 of teeth depending therefrom. Upper portion 32 has dovetail guide portions 38 formed thereon (FIG. 3) which are slidably received in mating slots in support portion 16 of member 14. Upper portion 32 of comb device 30 has chamber 40 formed therein. Rows 34, 36 of teeth are transversely spaced-apart at their upper ends and converge downwardly to point 42. Upper portion 32 has opening 44 formed therein which, when comb device 30 is attached to support portion 16, communicates with passage section 20. Chamber 40 communicates with the space between the upper ends of rows 34, 36 of teeth and thus with spaces 46 between the individual tooth elements.

Pressurized container 12 is of the type having an internal valve shown in dashed lines at 48 in FIG. 1. Valve 48 has hollow valve stem 50 extending therefrom which, when depressed, actuates valve 48 to permit liquid under pressure to be released from container 12.

Elongated tube 52 is positioned in passage section 20. Spray nozzle 54 having a plurality of openings 56 therein is connected to forward end 58 of tube 52 and extends through opening 44 into chamber 40. The other end 60 of tube 52 has grommet 62 thereon which slidably and sealingly receives stem 50 of valve 48 (FIG. 2). Valve stem 50 has abutment ring 64 thereon intermediate grommet 62 and container 12.

Lever member 66 is pivotally mounted on support portion 16 of member 14 as at 68. Lever member 66 has yoke portion 70 which embraces end 60 of tube 52 between abutment rings 72, 74 secured to end 60 of tube 52. Release buttom 76 is attached to lever member 66 and spring 78 acting between release buttom 76 and support portion 16 of member 14 normally urges lever member 66 and tube 52 to the position shown in FIG. 1 and in solid lines in FIG. 2.

It will now be seen that manual depression of release buttom 76 will result in axially moving tube 52 to the right as viewed in FIGS. 1 and 2, as shown by arrow 80, until grommet 62 engages abutment ring 64 on valve stem 50. Further movement of tube 52 toward the right in response to further manual depression of release button 76 will result in depression of valve stem 50 by means of abutment ring 64 thus causing release of the pressurized fluid in container 12 into tube 52 and in turn out of openings 56 in spray nozzle 54 into the interior of chamber 40 for distribution onto the tooth elements of rows 34, 36 of comb teeth. It will be seen that upon release of manual pressure on release button 76, spring 78 will return lever member 66 and tube 52 to the position shown in FIG. 1 and in solid lines in FIG. 2 thus permitting valve stem 50 to extend (under the influence of a spring, not shown, in valve 48) thus terminating the release of fluid into tube 52.

Comb device 30 has front portion 82 which, in the assembled position of comb device 30, abuts front end 84 of support portion 16 of member 14. Comb device 30 is maintained in its assembled position by spring latch 86 which engages front portion 82. Comb device 30 is preferably integrally formed of molded plastic material.

Referring now to FIGS. 4 and 5 in which like elements are indicated by like reference numerals and similar elements by primed reference numerals, comb device 30 of FIG. 1 may be replaced by brush device 88. Brush device 88 comprises body portion 90 having chamber 40' formed therein. Rows 92 of bristle elements are attached to body portion 98 and depend therefrom. Openings 94 are formed in body portion 98 between bristle rows 92 communicating with chamber 40' and serve to distribute the liquid sprayed into chamber 40' by nozzle 54 onto bristle elements 92.

Figure 6:
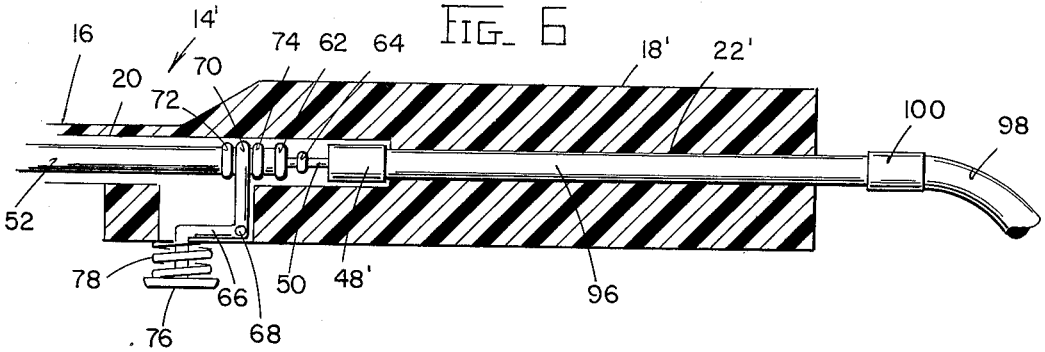
FIG. 6 is a fragmentary longitudinal sectional view showing another embodiment of the invention.

Referring now to FIG. 6 in which like elements are again indicated by like reference numerals and similar elements by primed reference numerals, there is shown an embodiment of the invention for use with an external pressurized source of liquid (not shown). Here, handle portion 18' of member 14' has passage section 22' therein which communicates with passage section 20 in support portion 16. Tube 96 is retained in passage section 22' and has valve 48' connected to its inner end. Tube 98 connected to external source of pressurized liquid (not shown) is coupled to tube 96 by connector 100. The embodiment shown in FIG. 6 functions in a manner identical to that described above in connection with the embodiment of the previous figures.

Figure 7:
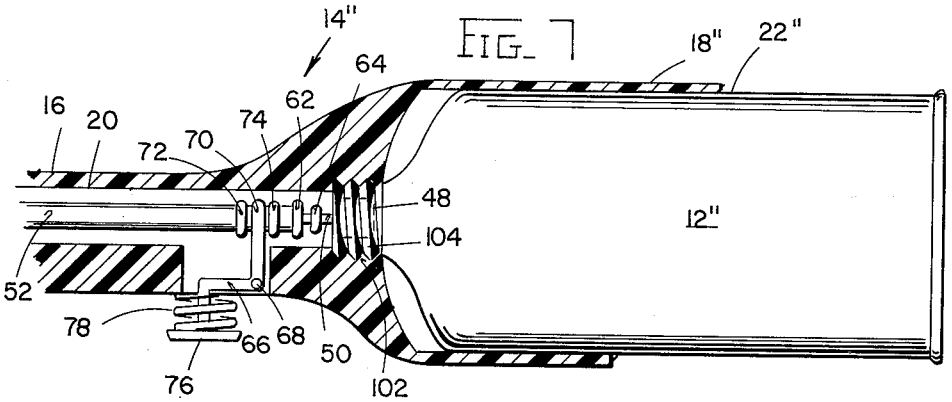
FIG. 7 is a fragmentary longitudinal sectional view showing yet another embodiment of the invention.

Referring now to FIG. 7 in which like elements are again indicated by like reference numerals and similar elements by double primed reference numerals, passage section 22'' in handle portion 18'' of member 14'' is joined to passage section 20 in support portion 16 by internally threaded section 102 which receives threaded neck portion 104 of pressurized container 12''. Pressurized container 12'' has internal valve 48 and valve stem 50 and the embodiment of FIG. 7 again functions in a manner identical to the functioning of the embodiment shown in FIG. 1. When pressurized container 12'' having threaded neck portion 104 is employed with the embodiment of FIG. 7, the hinged cover member 24 of the embodiment of FIG. 1 may be eliminated.

Figure 8:
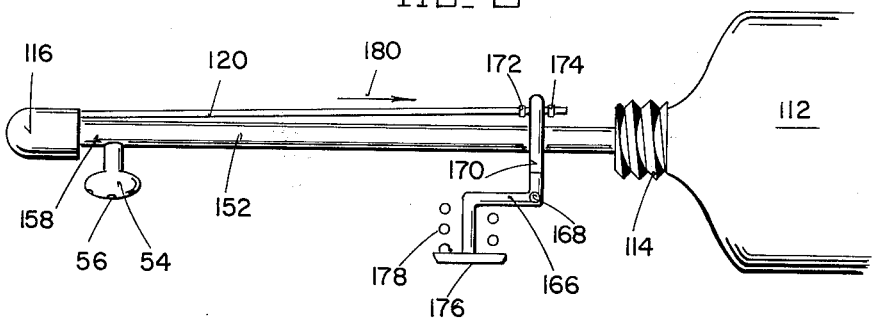
FIG. 8 is a fragmentary view showing a further embodiment of the invention.

Referring now to FIG. 8, an embodiment of the invention is shown which may be used with an unpressurized container 112 of hair dressing. The embodiment of FIG. 8 may be housed in a molded member substantially like member 14'' of FIG. 7. Here, elongated tube 152 has one end thereof connected to threaded neck portion 114 of container 112. Spray nozzle 54 is connected to tube 152 adjacent its outer end 158. Conventional pump 116 is connected to outer end 158 of tube 152 and is actuated by elongated rod 120 extending parallel with tube 152. Lever member 166 is pivotally mounted on support portion 16 of member 14'' (FIG. 7), as at 168, and has yoke portion 170 which passes around tube 152 and actuates rod 120 by means of abutment rings 172, 174, thereon.

It will now be seen that manual depression of release button 176 against spring 178 will move lever 166 and rod 120 to the right, as shown by arrow 180, thereby actuating pump 116 to withdraw liquid from container 112 and to force the same out of spray nozzle 54 into compartment 40 (or 40'). Release of the manual pressure on release button 176 causes spring 178 to return lever member 166 and rod 120 to the normal position as shown in FIG. 8.

It will readily be understood that either comb device 30 or brush device 88 may be employed with any of the embodiments of FIGS. 6, 7 and 8.

It will now be seen that the invention permits interchangeable use of comb device 30 and brush device 88 and ready removal of either one for cleaning. It will further be seen that the invention permits even distribution of the sprayed hair dressing onto the tooth elements of comb device 30 or bristle elements of brush 88 which, in turn, permits the hair dressing to be applied not only on the outer part of the hair but also on the interior parts thus eliminating waste of hair dressing.

While there have been described above the principles of this invention in connection with specific apparatus, it is to be clearly understood that this description is made only by way of example and not as a limitation to the scope of the invention.

What is claimed is:

1. Apparatus for grooming the hair while spraying a liquid thereon comprising: an elongated member having a support portion connected to a handle portion, said member having an elongated passage formed therein extending between said portions, a hair grooming device carried by said support portion and having a plurality of hair grooming elements thereon, said device having an elongated chamber therein communicating with said passage and elements, an elongated tube in said passage and having opposite ends, said tube having dispensing means thereon adjacent one end thereof for dispensing liquid into said chamber for distribution to said elements, said chamber providing attachment for at least two longitudinal rows of elements; one of said rows being laterally spaced in one direction from said dispensing means and another of said rows being laterally spaced in the opposite direction of said dispensing means; whereby said elements are in interceptive distributive relation on either lateral side of said dispensing means, the other end of said tube being adapted to be connected to a source of liquid, and control means on said support portion intermediate said handle portion and device and coupled to said source for causing a flow of liquid in said tube.

2. The apparatus of claim 1 wherein said source of liquid is under pressure and includes valve means in said passage for releasing liquid from said source, said tube being axially movable in said passage, said other end of said tube communicating with said valve means and being adapted to actuate the same in response to axial movement of said tube thereby to release liquid into said tube, said control means acting on said tube to move the same axially thereby to actuate said valve means.

3. The apparatus of claim 1 wherein said device is a comb having an upper portion carried by said support portion, said elements being two rows of teeth depending from said upper portion, said rows of teeth being transversely spaced-apart at their upper ends and converging to a point at their lower ends, said chamber being formed in said upper portion and communicating with the space between said upper ends of said rows of teeth.

4. The apparatus of claim 1 wherein said device is a brush having a body portion carried by said support portion, said elements being bristles attached to said body portion, said chamber being formed in said body portion, said body portion having openings therein distributed across said body portion and between said bristles and communicating with said chamber.

5. The apparatus of claim 1 wherein said chamber comprises a planar elongated surface having an opening centrally thereof to receive said dispensing means; laterally spaced element attaching surfaces depending from said planar surface; and said chamber being removably attached to said support portion.

6. The apparatus of claim 2 wherein said valve means includes a hollow stem element which releases fluid therethrough upon depression, said stem extending into said other end of said tube and being depressed upon axial movement thereof.

7. The apparatus of claim 2 wherein said control means comprises a lever member pivotally mounted on said support portion and having one end engaging said tube adjacent said other end thereof, means on the other end of said lever member for manually actuating the same, and spring means acting on said lever member for returning the same and said tube to a normal position in which said valve is closed.

8. The apparatus of claim 2 wherein said source of liquid is remotely located, said passage having sections in said support and handle portions, another tube in said handle section of said passage, a flexible tube connected to one end of said other tube and being adapted to be connected to said source, the other end of said other tube having said valve means thereon in said handle section of said passage.

9. The apparatus of claim 3 wherein said upper portion of said comb is removably attached to said support portion.

10. The apparatus of claim 6 wherein said other end of said tube slidably embraces said stem element, said stem element having an abutment thereon which is engaged by said other end of said tube upon axial movement thereof thereby to depress said stem.

* * * * *